US010859012B2

(12) United States Patent
Koo

(10) Patent No.: US 10,859,012 B2
(45) Date of Patent: Dec. 8, 2020

(54) METHOD AND SYSTEM FOR DIAGNOSING FAULT OF DUAL PURGE SYSTEM

(71) Applicants: Hyundai Motor Company, Seoul (KR); Kia Motors Corporation, Seoul (KR)

(72) Inventor: Bon Chang Koo, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/588,216

(22) Filed: Sep. 30, 2019

(65) Prior Publication Data

US 2020/0318563 A1 Oct. 8, 2020

(30) Foreign Application Priority Data

Apr. 4, 2019 (KR) ..... 10-2019-0039701

(51) Int. Cl.
*F02D 41/22* (2006.01)
*F02D 41/00* (2006.01)
*F02M 25/08* (2006.01)

(52) U.S. Cl.
CPC ..... *F02D 41/0037* (2013.01); *F02D 41/004* (2013.01); *F02D 41/0042* (2013.01); *F02M 25/0836* (2013.01); *F02D 2250/41* (2013.01); *F02M 25/089* (2013.01)

(58) Field of Classification Search
CPC ..... F02D 41/0037; F02D 41/0042; F02D 41/004; F02D 2250/41; F02D 41/22; F02D 41/221; F02D 41/222; F02D 2041/223; F02D 2041/224; F02D 2041/225; F02M 25/0836; F02M 25/089
USPC ..... 123/516, 518, 520, 559.1; 701/107; 73/114.38, 114.39, 114.43
See application file for complete search history.

(56) References Cited

U.S. PATENT DOCUMENTS 10,196,992 B2 * 2/2019 Imaizumi ..... F02B 37/16
2015/0292421 A1 10/2015 Pursifull et al.
2016/0305352 A1 * 10/2016 Pursifull ..... F02M 35/104
2016/0377031 A1 * 12/2016 Pursifull ..... F02D 41/0032 60/602

FOREIGN PATENT DOCUMENTS

JP H08135524 A 5/1996

* cited by examiner

*Primary Examiner* — Hai H Huynh
(74) *Attorney, Agent, or Firm* — Mintz Levin Cohn Ferris Glovsky and Popeo, P.C.; Peter F. Corless

(57) ABSTRACT

A method for diagnosing a fault situation of a negative-pressure generation line using a fuel tank pressure sensor that detects the pressure of a fuel tank is provided. The method detects pressure in a fuel tank measured by a fuel tank pressure sensor when a turbocharger is operated for boosting and a purge valve is operated and diagnoses a current situation as a fault situation in which an engine negative-pressure generation line remains open when a pressure change value calculated based on the pressure difference of the fuel tank exceeds a reference value. A warning of a fault situation is then output when a fault is determined.

11 Claims, 4 Drawing Sheets

METHOD AND SYSTEM FOR DIAGNOSING FAULT OF DUAL PURGE SYSTEM

CROSS-REFERENCE TO RELATED APPLICATION

This application claims the priority benefit of Korean Patent Application No. 10-2019-0039701, filed on Apr. 4, 2019, the disclosure of which is incorporated herein by reference

BACKGROUND

1. Field of the Invention

The present disclosure relates to a method and system for diagnosing a fault of a dual purge system, and more particularly, to a method and system that diagnose a fault situation of a negative-pressure generation line using a fuel tank pressure sensor that detects the pressure of a fuel tank.

2. Description of the Prior Art

Evaporation gas (oil gas) is generated when a fuel in a fuel tank is evaporated by external heat or during refueling. A method of collecting such evaporation gas using a canister is used and the evaporation gas collected in the canister is mixed with air in an intake manifold through a purge system and then burned in a combustion chamber.

Meanwhile, a multi-point injection (MPI) engine is used to comply with environments regulations regarding evaporation gas through a single purge system. However, a single purge system is unable to be used for a turbo gasoline direct injection (GDI) engine since positive pressure is generated in an intake manifold in turbo operation. In other words, as a turbocharger is operated, compressed air flows into the intake manifold and positive pressure is generated in the intake manifold, and thus, it may be difficult to achieve the purge function using existing single purge systems.

Accordingly, recently, efforts have been made to satisfy regulations and a commercial value by applying a dual purge system to a turbo GDI engine. In other words, a device that forcibly generates negative pressure when a turbocharger is operated, whereby it is possible to purge evaporation gas, which is discharged from a canister, in a surge tank when engine negative pressure is generated, and to transfer evaporation gas into a combustion chamber by generating negative pressure using a negative pressure generator when a turbocharger is operated.

Further, such a negative pressure generator includes a pressure sensor separately from a fuel tank pressure sensor on a fuel tank, to diagnose a fault situation of the negative pressure generator using a pressure value measured by the pressure sensor. However, the pressure sensor is installed to diagnose a fault in the negative pressure generator, thus generating an additional cost to mount the pressure sensor is generated. Accordingly, there is a need for a plan to diagnose a fault in a negative pressure generator without the pressure sensor.

The description provided above as a related art of the present disclosure is merely for helping understanding the background of the present disclosure and should not be construed as being included in the related art known by those skilled in the art.

SUMMARY

The present disclosure provides a method and system for diagnosing a fault of a dual purge system, the method and system being able to diagnose a fault situation of a negative-pressure generation line using a fuel tank pressure sensor that measures the pressure of a fuel tank.

In view of the above aspect, a method of diagnosing a fault of a dual purge system in which an engine negative-pressure generation line is connected between a purge valve and a front end of a surge tank, recirculation flow line is connected between a front end of a turbocharger and a front end of a throttle valve, and a forcible negative-pressure generation line is connected between the purge valve and a portion connected to the front end of the turbocharger and the recirculation flow line to collect evaporation gas of fuel tank in a canister operated to be purged selectively in one of the two lines, may include: detecting pressure in the fuel tank measured by a fuel tank pressure sensor when the turbocharger is operated for boosting and the purge valve is operated; diagnosing a current situation as a fault situation in which the engine negative-pressure generation line remains open when a pressure change value calculated based on the pressure difference of the fuel tank exceeds a reference value; and outputting a warning of a fault situation when a fault is determined.

In the first fault diagnosis, the current situation may be diagnosed as a fault situation in which a first check valve in the engine negative-pressure generation line remains open. The pressure change value may be calculated as a derivation per unit time of the difference between the pressure of the fuel tank measured during purging and the pressure of the fuel tank measured before purging, and the reference value may be determined based on boosting pressure of the turbocharger which may be a table value to have an increasing slope property of a linear function.

The method may further include diagnosing the current situation as a fault situation in which the forcible negative-pressure generation line maintained closed when the pressure change value calculated based on the pressure difference of the fuel tank is included in a reference range less than the reference value.

In this second fault diagnosis, the current situation may be diagnosed as a fault situation in which a second check valve in the forcible negative-pressure generation line remains closed. In addition, the current situation may be diagnosed as a fault situation in which the ejector connected among the forcible negative-pressure generation line, the recirculation flow line, and the turbocharger remains closed. The pressure change value may be calculated as a derivation per unit time of the difference between the pressure of the fuel tank measured during purging and the pressure of the fuel tank measured before purging, and the reference range may be determined based on a fuel level in the fuel tank, which may be a predetermined band including 0.

In view of the above aspect, a system for diagnosing a fault of a dual purge system in which an engine negative-pressure generation line is connected between a purge valve and a front end of a surge tank, recirculation flow line is connected between a front end of a turbocharger and a front end of a throttle valve, and a forcible negative-pressure generation line is connected between the purge valve and a portion connected to the front end of the turbocharger and the recirculation flow line to collect evaporation gas of fuel tank in a canister is operated to be purged selectively in one of the two lines, may include: an input unit to which the pressure in a fuel tank measured by a fuel tank pressure sensor while the turbocharger performs boosting and the purge value is operated is input; a calculation unit configured to calculate a pressure change value based on the pressure difference of the fuel tank; a determination unit configured to diagnose a current situation as a fault situation in which the engine negative-pressure generation line remains open when the pressure change value calculated by the calculation unit exceeds a reference value; and an output unit configured to output a warning of a fault situation when the determination unit diagnoses the current situation as a fault situation.

The determination unit may be configured to diagnose the current situation as a fault situation in which the forcible negative-pressure generation line remains closed when the pressure change value is included in a reference range less than the reference value. The calculation unit may be configured to calculate the pressure change value as a derivation per unit time of the difference between the pressure of the fuel tank measured during purging and the pressure of the fuel tank measured before purging. The system may further include a setting unit configured to determine a reference value based on boosting pressure of the turbocharger and determine the reference range based on a fuel level in the fuel tank.

According to the present disclosure, it may be possible to diagnose a fault situation of a negative-pressure generation line when the turbocharger is operated using the pressure change value measured by the fuel tank pressure sensor, whereby it may be possible to remove a pressure sensor additionally mounted in a negative-pressure generation line in the related art, thus decreasing the manufacturing cost of a vehicle.

BRIEF DESCRIPTION OF THE DRAWINGS

The above and other aspects, features and advantages of the present disclosure will be more apparent from the following detailed description taken in conjunction with the accompanying drawings, in which.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Furthermore, control logic of the present disclosure may be embodied as non-transitory computer readable media on a computer readable medium containing executable program instructions executed by a processor, controller/control unit or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

Figure 1:
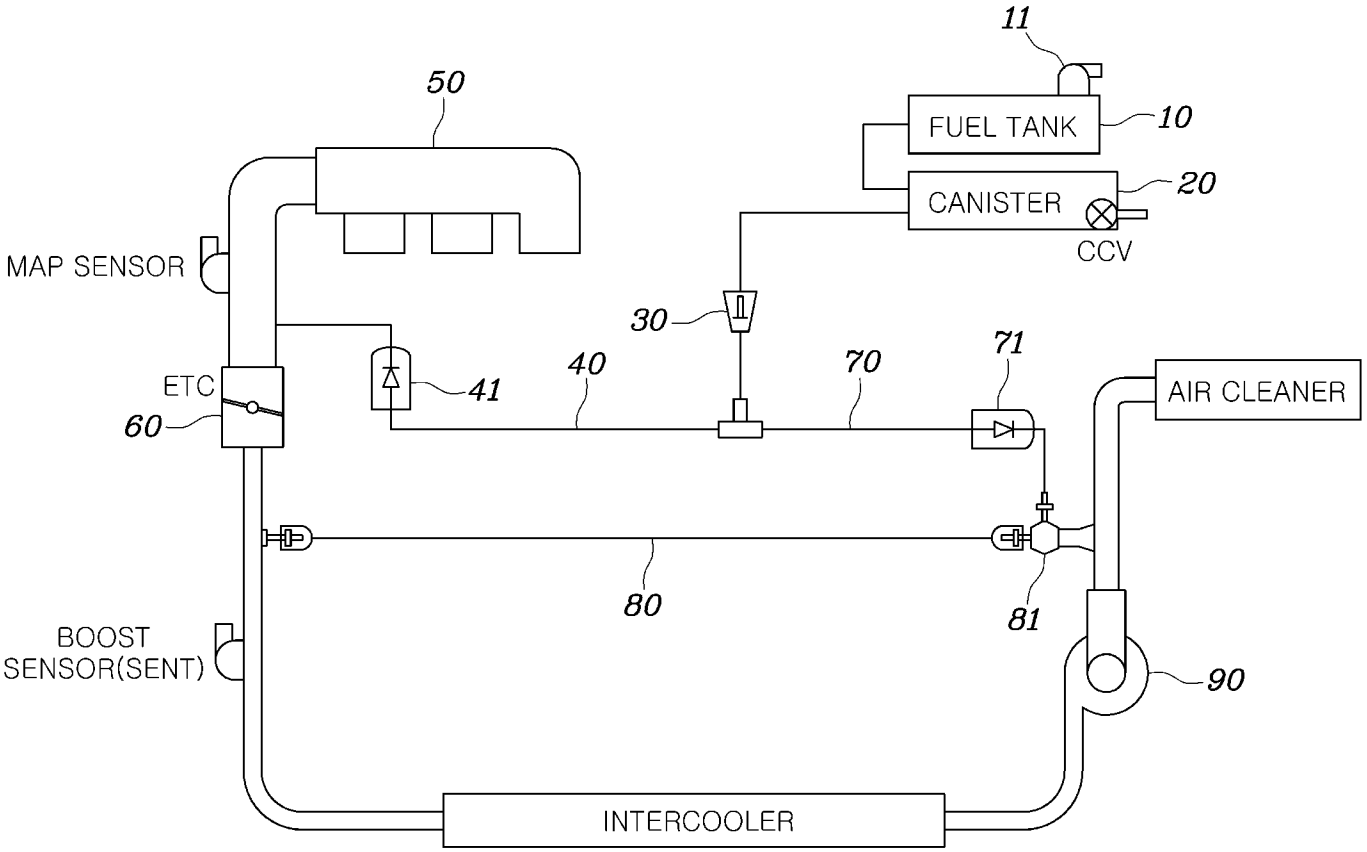
FIG. 1 is a diagram showing the entire configuration of an automotive dual purge system according to the present disclosure.

Exemplary embodiments of the present disclosure are described hereafter in detail with reference to the accompanying drawings. FIG. 1 is a diagram showing an automotive dual purge system to which the present disclosure may be applied, in which a fuel tank pressure sensor 11 may be configured to measure the pressure in a fuel tank 10.

Further, a canister 20 may be provided to collect evaporation gas that is discharged from the fuel tank 10 and may be connected with a purge valve 30 to purge the evaporation gas collected in the canister 20. An engine negative-pressure generation line 40 may be connected between the purge valve 30 and the front end of a surge tank 50, and thus, when negative pressure is generated in the engine, the evaporation gas flowing from the purge valve 30 may flow into the surge tank 50 through the engine negative-pressure generation line 40, whereby the evaporation gas may be purged.

In addition, an ejector 81 may be disposed at the front end a turbocharger 90, a recirculation flow line 80 may be connected between the ejector 81 and the front end of a throttle valve 60, and a forcible negative-pressure generation line 70 may be connected between the purge valve 30 and the ejector 81 connected to the front end of the turbocharger 90 and to the recirculation flow line 80, and thus, when positive pressure is generated in the engine, evaporation gas flowing from the purge valve 30 may flow into the surge tank 50 through the forcible negative-pressure generation line 70, whereby the evaporation gas may be purged. A first check valve 41 and a second check valve 71 may be respectively disposed in the engine negative pressure line 40 and the forcible negative-pressure generation line 70 to prevent backflow of evaporation gas.

In other words, when negative pressure is generated in the engine, evaporation gas may be discharged from the canister 20 and may flow to the purge valve 30 by suction force generated by the engine negative pressure. The purge valve 30 may be operated in response to a signal from a controller CLR, the evaporation gas may flow into the surge tank 50 through the engine negative-pressure generation line 40, whereby the evaporation gas may be purged.

However, when positive pressure is generated in the engine by operation of the turbocharger 90, air may be circulated through the recirculation flow line 80 and the ejector 81, whereby negative pressure may be generated in the forcible negative-pressure generation line 70. Accordingly, when the purge valve 30 is operated in response to a signal from the controller CLR, the evaporation gas may flow into the surge tank 50 through the forcible negative-pressure generation line 70, and thus, the evaporation gas may be purged. In addition, a fault situation of the engine negative-pressure generation line 40 and forcible negative-pressure generation line 70 may be diagnosed based on a pressure change of the fuel tank 10 in the dual purge system diagnose of the present disclosure.

Figure 2:
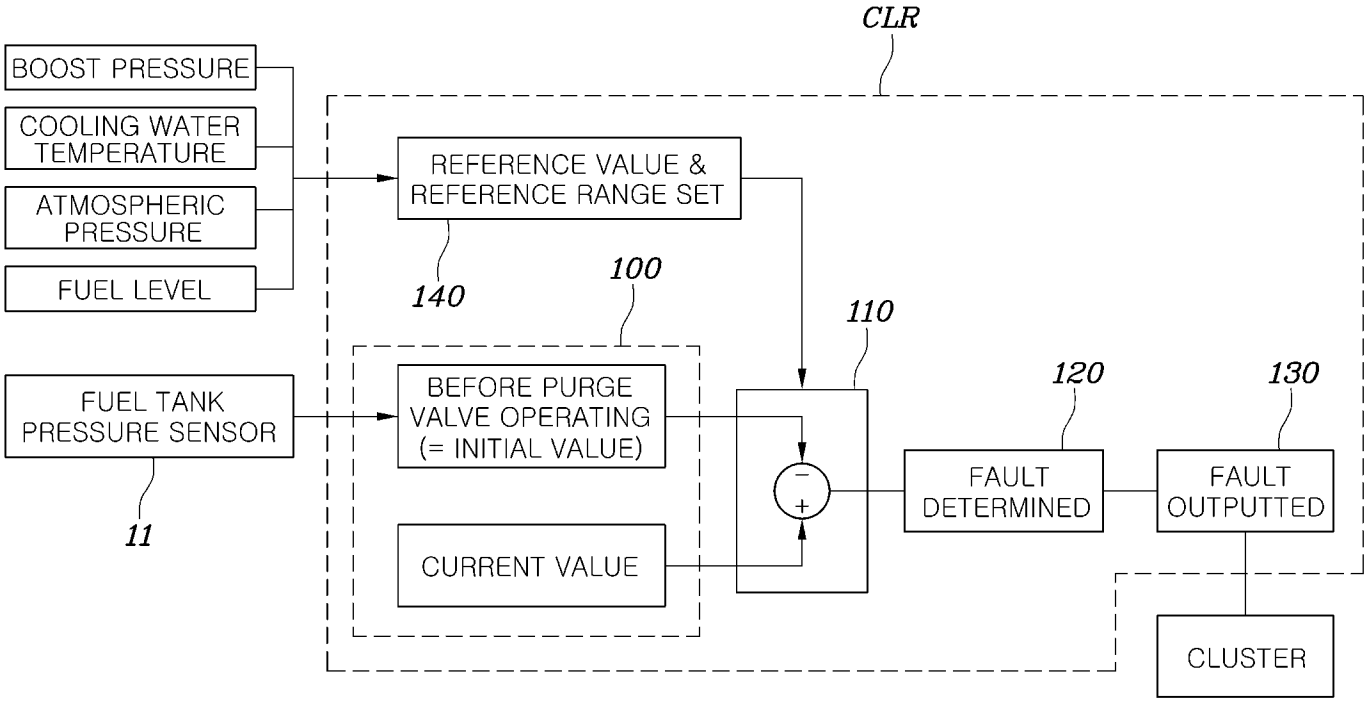
FIG. 2 is a diagram showing the configuration of a system for diagnosing a fault in a dual purge system according to the present disclosure.
Figure 3:
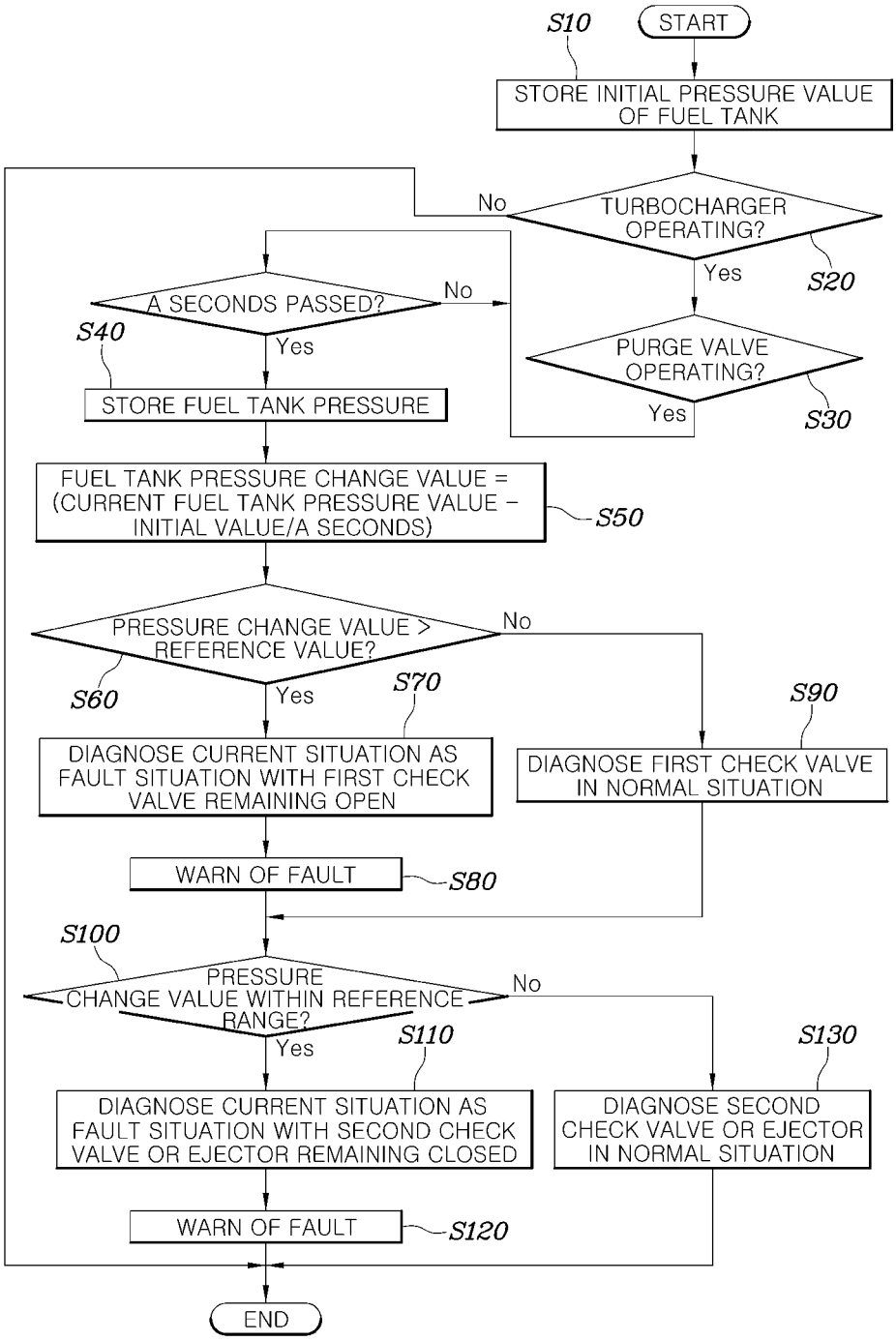
FIG. 3 is a diagram showing the flow of a fault diagnosis process for a dual purge system according to the present disclosure.

Referring to FIGS. 2 and 3, a method of diagnosing a fault of a dual purge system may include: detecting, by a controller CLR, pressure in the fuel tank 10 measured by the fuel tank pressure sensor 11 when the turbocharger 90 is operated for boosting and the purge valve 30 is operated; diagnosing, by the controller, the current situation as a fault situation (e.g., detecting a failure) in which the engine negative-pressure generation line 40 remains open when a pressure change value calculated based on a pressure difference of the fuel tank 10 exceeds a reference value (e.g., a first diagnosis); and outputting, by the controller, a warning of a fault situation in response to detecting a fault.

The controller according to exemplary embodiments of the present disclosure may be implemented through a non-volatile memory (not shown) configured to store algorithms for executing operation of various components of a vehicle or data about software commands for executing the algorithms, and a processor (not shown) configured to perform operation to be described below using the data stored in the memory. The memory and the processor may be individual chips. Alternatively, the memory and the processor may be integrated in a single chip. The processor may be implemented as one or more processors.

Further, in the first fault diagnosis process, the current situation may be diagnosed as a fault situation in which the first check valve 41 in the engine negative-pressure generation line 40 remains open. In other words, when the purge valve 30 is operated during boosting by the turbocharger 90, evaporation gas flows into the forcible negative-pressure generation line 70, and thus, the engine negative-pressure generation line 40 should be closed.

Figure 4:
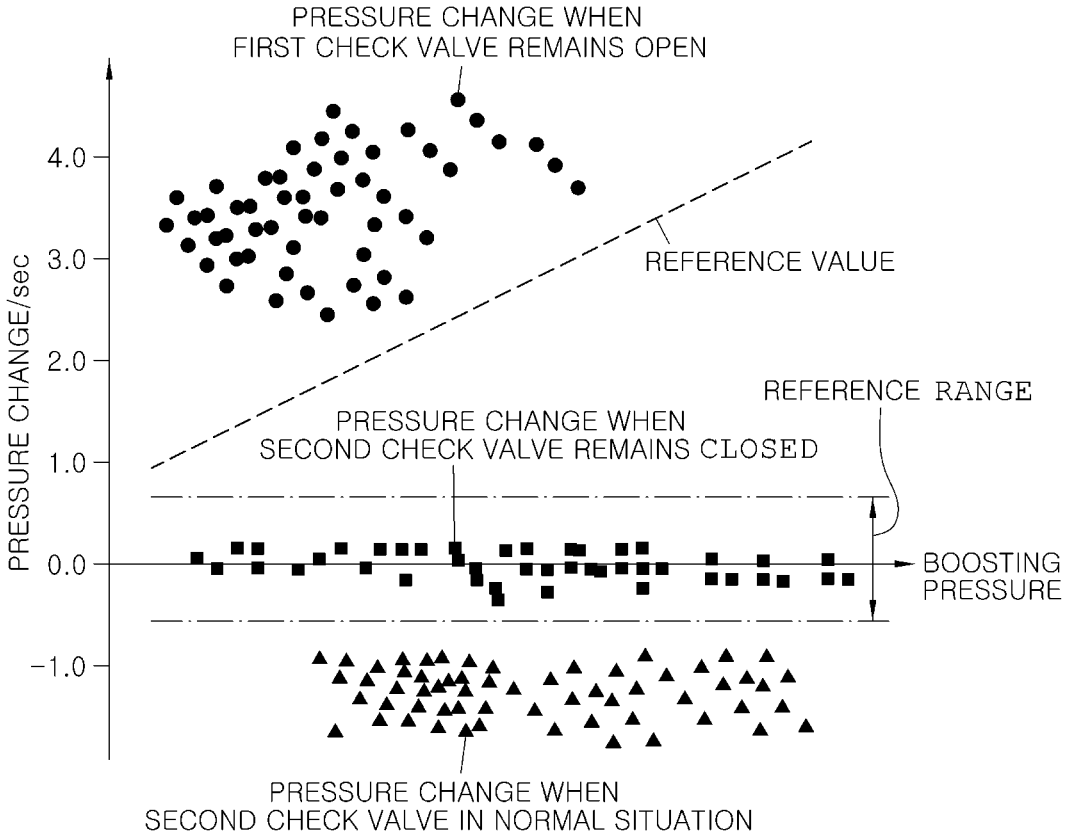
FIG. 4 is a diagram illustrating a pressure change in a fuel tank that occurs when a first check valve and a second check valve are in a break situation or a normal situation.

However, when the engine negative-pressure generation line 40 is not closed and remains open due to a fault (e.g., failure, malfunction, error) of the first check valve 41 etc., oversupplied air boosted by the turbocharger 90 may flow into the combustion chamber and flow back into the engine negative-pressure generation line 40, causing the pressure in the fuel tank 10 to increase. Accordingly, when the first check valve 41 remains open, as shown in FIG. 4, the pressure change value of the fuel tank 10 increases higher than the reference value, and thus, the current situation may be detected as a fault situation of the first check valve and a warning may be output to a driver regarding the fault situation. In other words, the warning may be output and displayed on a cluster within the vehicle.

Further, the pressure change value (or pressure change rate) of the fuel tank 10 may be calculated as a derivation per unit time of the difference between the pressure of the fuel tank 10 measured during purging and the pressure of the fuel tank 10 measured before purging. In other words, the pressure of the fuel tank 10 measured during purging is the pressure value of the fuel tank 10 currently measured, and the pressure of the fuel tank 10 measured before purging is an initial pressure value, which may be expressed as the following formula.

pressure change value of fuel tank=(current pressure value of fuel tank−initial pressure value)/unit time The reference value that is compared with the pressure change value of the fuel tank 10 is a value that may be determined based on boosting pressure of the turbocharger 90, which may be a table value to have an increasing slope property of a linear function.

The method may further include diagnosing the current situation as a fault situation in which the forcible negative-pressure generation line 70 remains closed when the pressure change value calculated based on the pressure difference of the fuel tank 10 is included in a reference range less than the reference value (e.g., a second diagnosis).

In the second fault diagnosis process, it may be possible to diagnose the current situation as a fault situation in which the second check valve 71 in the forcible negative-pressure generation line 70 remains closed or a fault situation in which the ejector 81 connected among the forcible negative-pressure generation line 70, the recirculation flow line 80, and the turbocharger 90 remains closed. In other words, when the purge valve 30 is operated during boosting by the turbocharger 90, evaporation gas may flow into the forcible negative-pressure generation line 70, and thus, the forcible negative-pressure generation line 70 should be open.

However, when the forcible negative-pressure generation line 70 is not opened and remains closed due to a fault in the second check valve 71 or the ejector 81, negative pressure is not generated in the forcible negative-pressure generation line 70, and thus, the evaporation gas in the canister 20 is unable to be suctioned and the pressure of the fuel tank 10 does not change. Accordingly, when the second check valve 71 or the ejector 81 remains closed, as shown in FIG. 4, the pressure change value in the fuel tank 10 is in the reference range including 0, and thus, the current situation may be detected as a fault situation of the second check valve 71 or the ejector 81 and a warning may be output to a driver regarding the fault situation.

When the second check valve 71 or the ejector 81 is in a normal state, negative pressure is generated in the forcible negative-pressure generation line 70, and thus, the pressure change value of the fuel tank 10 may be expressed as a negative value. In particular, the pressure change value of the fuel tank 10 may be calculated as a derivation per unit time of the difference between the pressure of the fuel tank 10 measured during purging and the pressure of the fuel tank 10 measured before purging. In other words, the pressure of the fuel tank 10 measured during purging is the pressure value of the fuel tank 10 currently measured, and the pressure of the fuel tank 10 measured before purging is an initial pressure value, which may be expressed as the following formula.

pressure change value of fuel tank=(current pressure value of fuel tank−initial pressure value)/unit time The reference range that is compared with the pressure change value of the fuel tank 10 may be determined based on the fuel level in the fuel tank 10, which may be a table value including 0.

Moreover, FIG. 2 is a diagram showing the configuration of a system for diagnosing a fault of a dual purge system according to the present disclosure, which may include an input unit 100, a calculation unit 110, a determination unit 120, and an output unit 130, which may be components included in the controller CLR. In other words, the units may be operated by the controller.

Referring FIG. 2, the pressure in the fuel tank 10 measured by the fuel tank pressure sensor 11 while the turbocharger 90 performs boosting and the purge value 30 is operated may be input to the input unit 100. The calculation unit 110 may be configured to calculate a pressure change value based on the pressure difference of the fuel tank 10. For example, the pressure change value may be calculated as a derivation per unit time of the difference between the pressure of the fuel tank 10 measured during purging and the pressure of the fuel tank 10 measured before purging.

Further, the determination unit 120 may be configured to diagnose or detect the current situation as a fault situation in which the engine negative-pressure generation line 40 remains open when the pressure change value calculated by the calculation unit 110 exceeds a reference value. The determination unit 120 may also be configured to diagnose the current situation as a fault situation in which the forcible negative-pressure generation line 70 remains closed when the pressure change value is within a reference range that is less than the reference value. When the determination unit 120 diagnoses the current situation as a fault situation, the output unit 130 may be configured to output a warning of the fault situation.

The system may further include a setting unit 140 configured to determine a reference value based on boosting pressure of the turbocharger 90 and determine a reference range based on a fuel level in the fuel tank 10. The fault diagnosis by the dual purge system according to the present disclosure is described hereafter with reference to FIGS. 2 and 3. First, the pressure of the fuel tank 10 may be measured and stored by the fuel tank pressure sensor 11 before the purge valve 30 is operated (S10).

When the turbochargers 90 starts boosting (S20), whether the purge valve 30 is operated in the process of boosting of the turbocharger 90 may be determined (S30), and when the purge valve 30 is operated and A seconds passes, the pressure of the fuel tank 10 at this time may be measured and stored (S40). The pressure change value of the fuel tank 10 may be calculated based on the difference value for A seconds between the initial pressure of the fuel tank 10 measured in step S10 and the current pressure measured in step S40 (S50).

Further, a reference value and a reference range that correspond to the pressure change value may be set based on factors such as the boosting pressure of the turbocharger 90, the fuel level, the cooling water temperature, and the atmospheric pressure. In addition, whether the pressure change value exceeds the reference value may be determined (S60), and when the pressure change value is exceeded as the result of determination, the current situation may be diagnosed as a fault situation in which the first check valve 41 remains open (S70), and the driver may be warned of the fault situation through a cluster (S80).

However, when the pressure change value is not exceeded, the first check valve 41 may be diagnosed as in a normal situation (S90). Further, whether the pressure change value is determined to be within the reference range (S100), and when the pressure change value is within the reference range as the result of determination, the current situation may be diagnosed as a fault situation in which the second check valve 71 or the ejector 81 remains closed (S110), and the driver may be warned of the fault situation through a cluster (S120). However, when the pressure change value is beyond the reference range, the second check valve 71 and the ejector 81 may be diagnosed as being in a normal state (e.g., without failure) (S130).

As described above, the present disclosure may diagnose the current situation as a fault situation of the first check valve 41 when the pressure change value in the fuel tank 10 is greater than the reference value, and diagnose the current situation as a fault situation of the second check valve 71 or the ejector 81 when the pressure change value in the fuel tank 10 is within the reference range. Accordingly, it may be possible to diagnose a fault situation of a negative-pressure generation line when the turbocharger 90 is operated using the fuel tank pressure sensor 11 configured to measure the pressure in the fuel tank 10, whereby it may be possible to remove a pressure sensor additionally mounted in a negative-pressure generation line in the related art, thus also reducing the manufacturing cost of a vehicle.

On the other hand, although the present disclosure was described with reference to the detailed exemplary embodiments, it is apparent to those skilled in the art that the present disclosure may be changed and modified in various ways without the scope of the present disclosure and it should be noted that the changes and modifications are included in claims.

What is claimed is:

1. A method of diagnosing a fault of a dual purge system, comprising:

detecting, by a controller, pressure in a fuel tank in which evaporation gas is collected measured by a fuel tank pressure sensor when a turbocharger is operated for boosting and a purge valve is operated;

diagnosing, by the controller, a current situation as a fault situation in which an engine negative-pressure generation line, connected between the purge valve and a front end of a surge tank, remains open when a pressure change value calculated based on the pressure of the fuel tank exceeds a reference value; and outputting, by the controller, a warning of a fault situation when a fault is determined, wherein a recirculation flow line is connected between a front end of a turbocharger and a front end of a throttle valve and a forcible negative-pressure generation line is connected between the purge valve and a portion connected to the front end of the turbocharger and the recirculation flow line to collect the evaporation gas in a canister is operated to be purged selectively in one of the two lines.

2. The method of claim 1, wherein the current situation is diagnosed as a fault situation in which a first check valve in the engine negative-pressure generation line remains open.

3. The method of claim 1, wherein the pressure change value is calculated as a derivation per unit time of the difference between the pressure of the fuel tank measured during purging and the pressure of the fuel tank measured before purging, and the reference value is determined based on boosting pressure of the turbocharger, which is a table value to have an increasing slope property of a linear function.

4. The method of claim 1, further comprising:

diagnosing, by the controller, the current situation as a fault situation in which the forcible negative-pressure generation line remains closed when the pressure change value calculated based on the pressure difference of the fuel tank is within a reference range less than the reference value.

5. The method of claim 4, wherein the current situation is diagnosed as a fault situation in which a second check valve in the forcible negative-pressure generation line remains closed.

6. The method of claim 4, wherein the current situation is diagnosed as a fault situation in which the ejector connected among the forcible negative-pressure generation line, the recirculation flow line, and the turbocharger remains closed.

7. The method of claim 4, wherein the pressure change value is calculated as a derivation per unit time of the difference between the pressure of the fuel tank measured during purging and the pressure of the fuel tank measured before purging, and the reference range is determined based on a fuel level in the fuel tank, which is a predetermined band including 0.

8. A system for diagnosing a fault of a dual purge system in which an engine negative-pressure generation line is connected between a purge valve and a front end of a surge tank, recirculation flow line is connected between a front end of a turbocharger and a front end of a throttle valve, and a forcible negative-pressure generation line is connected between the purge valve and a portion connected to the front end of the turbocharger and the recirculation flow line such that evaporation gas of fuel tank collected in a canister is controlled to be purged selectively in one of the two lines, the system comprising:

an input unit to which the pressure in a fuel tank measured by a fuel tank pressure sensor while the turbocharger performs boosting and the purge value is operated is input;

a calculation unit configured to calculate a pressure change value based on the pressure of the fuel tank;

a determination unit configured to diagnose a current situation as a fault situation in which the engine negative-pressure generation line remains open when the pressure change value calculated by the calculation unit exceeds a reference value; and an output unit configured to output a warning of a fault situation when the determination unit diagnoses the current situation as a fault situation.

9. The system of claim 8, wherein the determination unit is configured to diagnose the current situation as a fault situation in which the forcible negative-pressure generation line remains closed when the pressure change value is within a reference range less than the reference value.

10. The system of claim 9, wherein the calculation unit is configured to calculate the pressure change value as a derivation per unit time of the difference between the pressure of the fuel tank measured during purging and the pressure of the fuel tank measured before purging.

11. The system of claim 9, further comprising:

a setting unit configured to determine a reference value based on boosting pressure of the turbocharger and determine the reference range based on a fuel level in the fuel tank.

* * * * *